United States Patent [19]

Schock

[11] Patent Number: 5,006,860

[45] Date of Patent: Apr. 9, 1991

[54] CONNECTION OF T SECTIONS BETWEEN HALF RINGS WITHIN ANNULAR HOUSING

[76] Inventor: Edward J. Schock, P.O. Box 1167, Lebanon, Pa. 17042

[21] Appl. No.: 345,218

[22] Filed: Apr. 28, 1989

[51] Int. Cl.[5] ..... H01Q 11/12

[52] U.S. Cl. ..... 343/742; 343/878; 343/891

[58] Field of Search ..... 343/806, 869, 870, 878, 343/879, 880, 887, 888, 890, 891, 892, 905, 908, 742; 248/165

[56] References Cited

U.S. PATENT DOCUMENTS 3,363,255 1/1968 Nienaber ..... 343/890

FOREIGN PATENT DOCUMENTS 1194925 6/1965 Fed. Rep. of Germany ..... 343/878
1279788 10/1968 Fed. Rep. of Germany ..... 343/880
0035502 4/1981 Japan ..... 348/878

*Primary Examiner*—Rolf Hille

*Assistant Examiner*—Peter Toby Brown

[57] ABSTRACT

Connection of two T-section posts between two half rings within an annular housing, whereby the T-section posts extend substantially parallel to each other and to the central axis of the bore of the annular housing. The annular housing may have a slightly tapered bore, whereby pressing the half rings into the bore of the annular housing presses the half rings tighter against the T-section posts, locking the T-section posts and half rings within the annular housing. The T-section posts may be rigid fiberglass-reinforced plastic. The annular housing may be a polyvinyl chloride slip coupling and the half rings may be cut sections of polyvinyl chloride pipe. The connection as described may be assembled by hand. A support structure for a UHF television receiving antenna uses two equal-length T-section posts connected between two half rings within an annular housing at each end of the posts; active antenna elements are attached to one T-section post and reflector elements are attached to the other.

10 Claims, 4 Drawing Sheets

CONNECTION OF T SECTIONS BETWEEN HALF RINGS WITHIN ANNULAR HOUSING

BACKGROUND—FIELD OF INVENTION

This invention relates to connection of two T-section posts between half rings within an annular housing, whereby the T-section posts extend substantially parallel to each other and to the central axis of the bore of the annular housing. A specific application is a pressed-together support means for a snapped-together UHF television receiving antenna.

SUMMARY OF THE INVENTION

A general object of the invention is to provide a means of maintaining two T-section posts in a fixed, substantially parallel, spaced relationship.

Another object is to create a secure assembly simply by pressing two half rings against the two T-section posts within the annular housing.

Another object is to adapt commonly available components, including plastic pipe and slip couplings, for use in a high-gain, directive, UHF television receiving antenna that may be marketed in kit form and assembled with ease. This invention complements the subject matter of U.S. Pat. No. 4,872,022, which was issued Oct. 3, 1989.

DRAWING FIGURES

REFERENCE NUMERALS IN DRAWINGS

Figure 1:
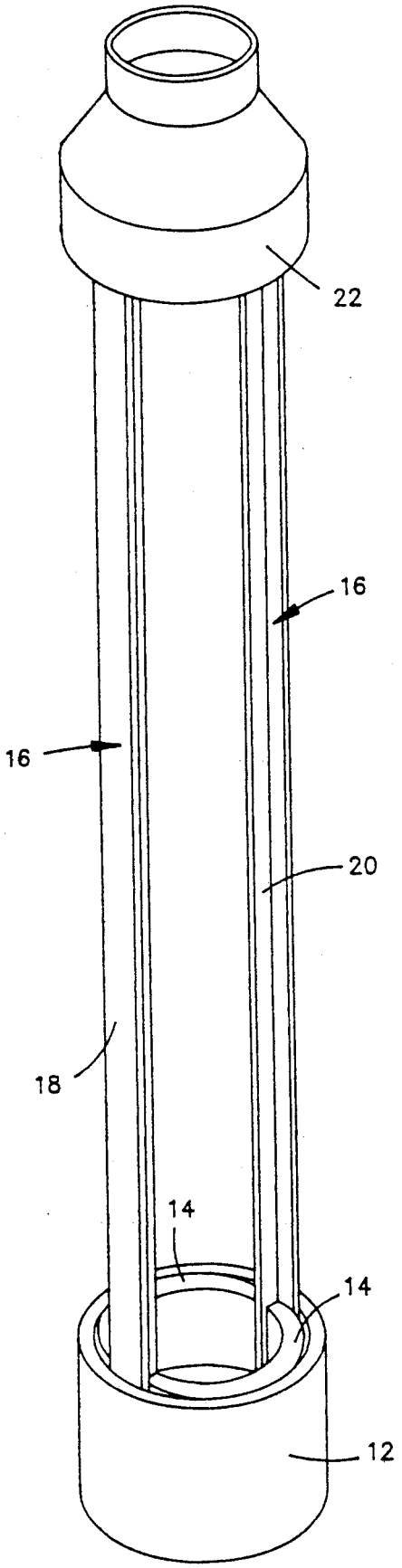
FIG. 1 is a perspective view of an assemblage of two half rings holding two T-section posts within a slip coupling.

10 antenna assemblage
12 slip coupling
14 half ring
16 T-section post
18 branch portion of T section
20 stem portion of T section
22 reducing coupling
24 tape shim
26 spacer
28 rubber band
30 notched face of spacer
32 central ridge of slip coupling
34 double snap clip
36 single snap clip
38 flanged disk
40 active loop
42 alligator clip
44 twin-lead transmission line
46 outer reflector loop
48 hooked end of outer reflector loop
50 inner reflector loop
52 stem-abutting edge of half ring
54 C edge of half ring
56 convex face of half ring
58 concave face of half ring
60 outer wall of slip coupling
62 inner wall of slip coupling

DETAILED DESCRIPTION

FIG. 1 shows the following components: a slip coupling 12, two half rings 14, two T-section posts 16, and a reducing coupling 22.

Figure 4:
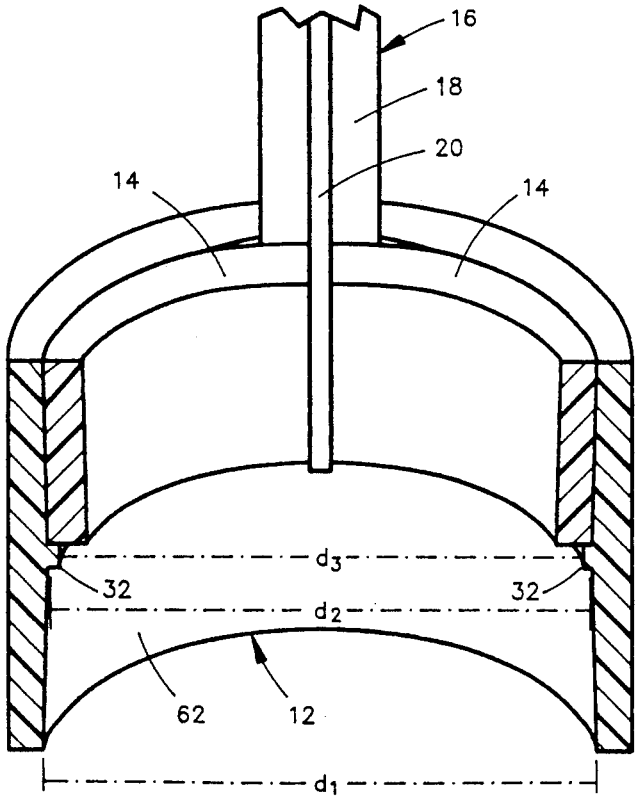
FIG. 4 is a sectional view showing a T-section post between two half rings within a slip coupling.

The slip coupling 12 is a standard plastic plumbing fitting. A preferred embodiment is made of polyvinyl chloride, but other materials also may be used. The slip coupling 12 illustrated in the drawings is of the type commonly used to join lengths of three-inch-inside-diameter Schedule 40 polyvinyl chloride pipe. The slip coupling 12 is an annulus with an approximate height of three and one-quarter inches (approximately eighty-three millimeters). The outside diameter is approximately four inches (approximately one hundred millimeters). The slip coupling 12 is essentially bilaterally symmetrical in relation to a plane bisecting its height. The bore of the slip coupling 12 is slightly tapered from a maximum diameter at each of the two openings in the slip coupling 12 to a minimum diameter at the plane that bisects the height. At each of the two openings the inside diameter ($d_1$ in FIG. 4) is approximately three and sixty-five one hundred twenty-eighths inches (approximately eighty-nine millimeters). At a depth of approximately one and one-half inches (approximately forty millimeters) into the bore of the slip coupling 12, the inside diameter ($d_2$ in FIG. 4) is approximately three and thirty-one sixty-fourths inches (approximately eighty-eight millimeters). On the plane that bisects the height of the slip coupling 12 is a ring-like central ridge 32 that projects inward toward the central axis of the bore from the otherwise smooth surface of the inner wall 62 of the slip coupling 12, as shown in FIG. 4. The inside diameter ($d_3$ in FIG. 4) of the central ridge is approximately three and five-sixteenths inches (approximately eighty-four millimeters). The thickness of the central ridge 32, measured parallel to the central axis of the bore of the slip coupling 12, is approximately three sixteenths of an inch (approximately five millimeters).

Figure 7:
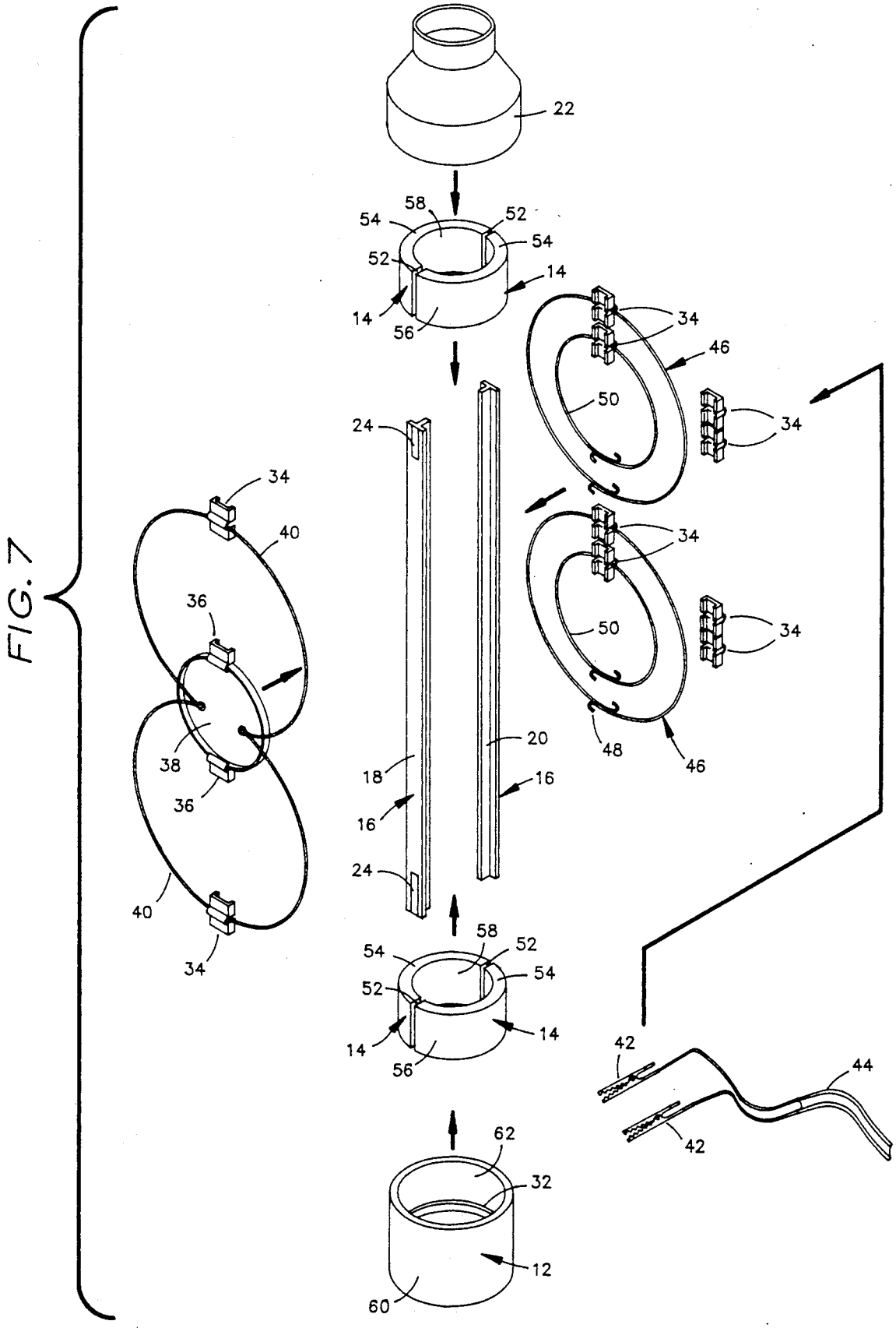
FIG. 7 is an exploded view of the components used in the antenna assemblage of FIG. 6.

The depiction of the slip coupling 12 in FIG. 7 shows an outer wall 60 and an inner wall 62. In order to use the half rings 14, it is necessary for the inner wall 62 of the slip coupling 12 to define a substantially circular aperture. However, the outer wall 60 need not necessarily be circular. The slip coupling 12 is described as an annulus, or more broadly as an annular housing, which is defined here as an object having the circular aperture of an annulus but not necessarily having a circular outer wall.

Figure 3:
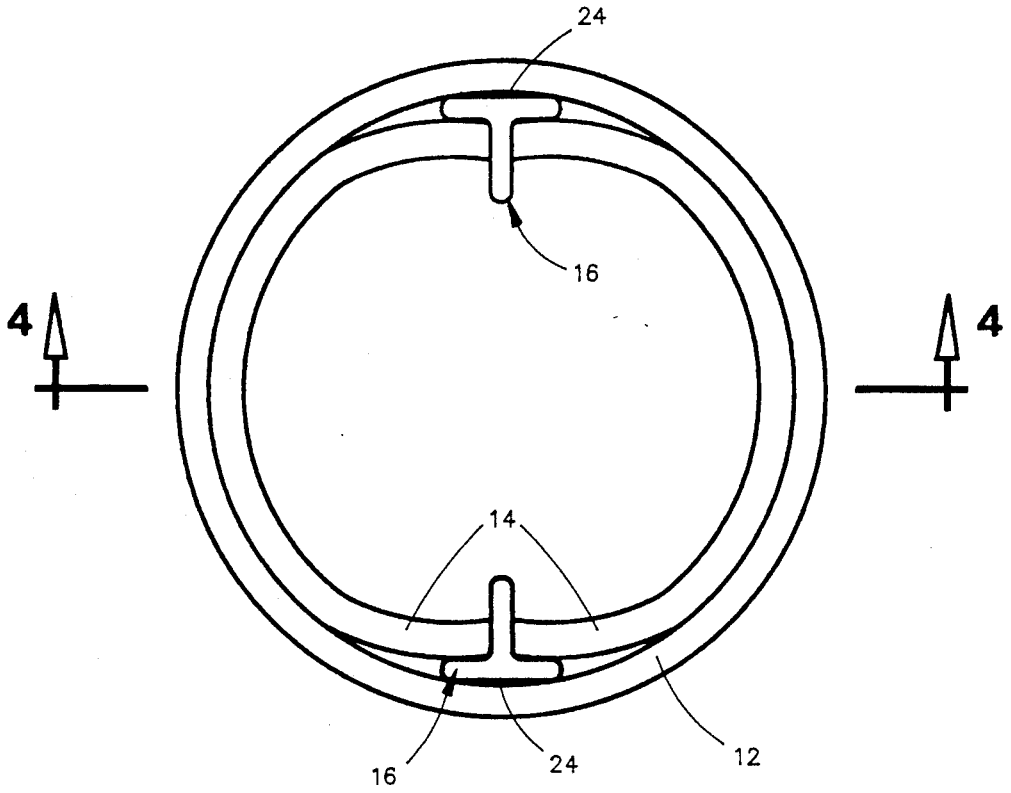
FIG. 3 is a top view of the assemblage of the two half rings holding two T-section posts within a slip coupling.

The two T-section posts 16 shown in FIG. 1 are made of a rigid fiberglass-reinforced plastic. Each T-section post 16 has a stem portion 20 extending from the center of a branch portion 18. The stem portion 20 is substantially a perpendicular bisector of the branch portion 18. Both the stem portion 20 and the branch portion 18 have a thickness of approximately one eighth of an inch (approximately three millimeters). The width of the branch portion 18 is approximately five eighths of an inch (approximately sixteen millimeters). The width of the stem portion 20 perpendicular to the width of the branch portion 18 is approximately five sixteenths of an inch (approximately nine millimeters). The edges of the branch portion 18 and the edge of the stem portion 20 are rounded, as can be seen in FIG. 3. The two T-section posts should be equal to each other in length for connecting the couplings and half rings at both ends of the T-section posts.

In a preferred embodiment the half rings 14 are created from Schedule 40 polyvinyl chloride pipe having a uniform inside diameter of three inches (approximately seventy-six millimeters), a uniform outside diameter of approximately three and one-half inches (approximately eighty-nine millimeters), and a uniform wall thickness of approximately one quarter of an inch (approximately six millimeters). The half rings 14 may be created by: (1) ripping through a diameter of a length of pipe, creating two identical half ring lengths; (2) planing the half ring lengths along the cut edges, removing sufficient material from the cut edges so that the two planed half ring lengths and the thicknesses of the stem portions 20 of the two T-section posts 16 may be accommodated within the bore of the annular housing; and (3) crosscutting the planed half ring lengths into a series of half rings 14. A planed half ring length of ten feet (approximately three hundred four centimeters) will yield eighty half rings 14 when crosscut every one and one-half inches (thirty-eight millimeters) along its length.

The half rings 14 are shown in detail in FIG. 7. Each half ring 14 has a convex face 56, a concave face 58, and two parallel C edges 54 whose flat surfaces are perpendicular to two co-planar, rectangular, stem-abutting edges 52. The distance around the arc of the convex face 56 is approximately five and one-quarter inches (approximately one hundred thirty-four millimeters).

The reducing coupling 22 illustrated in FIG. 1 also is a standard plumbing fitting. The reducing coupling 22 of the preferred embodiment is a polyvinyl chloride external slip coupling commonly used for joining a length of three-inch-inside-diameter Schedule 40 polyvinyl chloride pipe to a length of one-and-one-half-inch-inside-diameter Schedule 40 polyvinyl chloride pipe. As in the slip coupling 12, the inside diameter of the reducing coupling 22 is slightly tapered into the bore. As shown in FIG. 7, two half rings 14 also are used to connect the T-section posts 16 within the reducing coupling 22.

In FIG. 1, an end of each of the two T-section posts 16 is shown within the bore of the slip coupling 12. The two T-section posts 16 are shown extending parallel to each other and to the central axis of the bore of the slip coupling 12. The flat face of the branch portion 18 of each T-section post 16 is substantially against the inner wall 62 of the slip coupling 12. The edge of the stem portion 20 of each T-section post 16 faces the edge of the stem portion 20 of the other T-section post 16 across the bore of the slip coupling 12. Two half rings 14 are within the bore of the slip coupling 12. Each stem-abutting edge 52 of each half ring 14 is against the stem portion 20 of one of the T-section posts 16. The convex face 56 of each half ring 14 is against the inner wall 62 of the slip coupling 12, except near each T-section post, where the branch portion 18 of the T-section post 16 is between the convex face 56 of each half ring 14 and the inner wall 62 of the slip coupling 12. The stem portion 20 of each T-section post 16 is between a stem-abutting edge 52 of one half ring 14 and a stem-abutting edge 52 of the other half ring 14.

The polyvinyl chloride half rings 14 of the preferred embodiment are firm, yet resilient, and tend to spring back to their original shapes after the ends are pinched together to slide over the branch portions 18 of the T-section posts 16. By holding the two T-section posts 16 within the slightly tapered bore of the annular housing, and pressing the two half rings 14 into that tapered bore, the half rings 14 are pressed tighter against the T-section posts 16, locking the assembled components solidly in place. No glues or solvents are necessary to hold the assembled components together.

Figure 2:
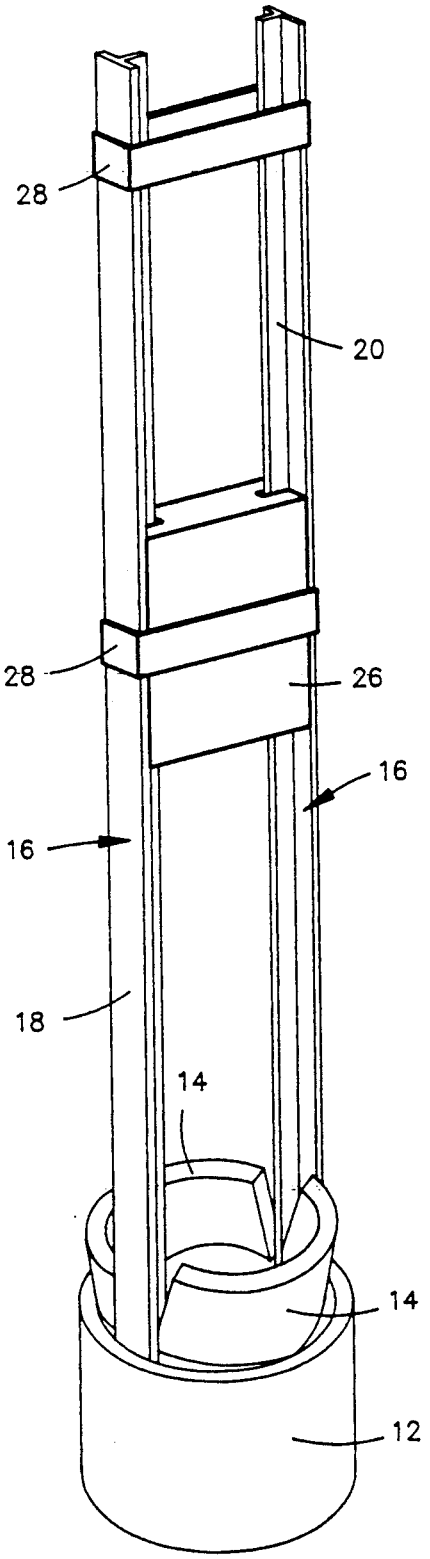
FIG. 2 is a perspective view of components used to press the T-section posts against the inner wall of the slip coupling during insertion of the half rings.
Figure 5:
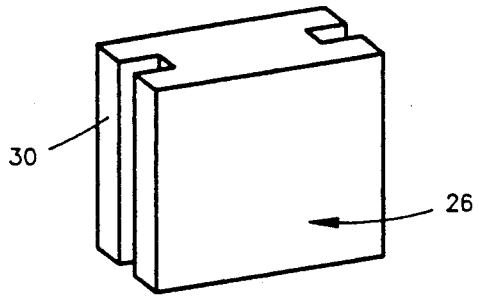
FIG. 5 is a perspective view of a spreader used during initial assembly of the components.

In order to assemble by hand the T-section posts 16 and the half rings 14 within the bore of the annular housing, the two T-section posts 16 must be held in place across from one another against the inner wall 62 of the annular housing while the two half rings 14 are pressed into the bore. A means of holding the two T-section posts 16 for assembly is shown in FIG. 2. A spacer 26 is placed between the two T-section posts 16. As shown in FIG. 5, the spacer 26 has two parallel notched faces 30. The distance between the notched faces should be substantially equal to the diameter of the bore of the annular housing. The other dimensions of the spacer are not critical. One possible embodiment of the spacer 26 is a block of wood with dimensions of three and one-half inches by three and one-half inches by three quarters of an inch (eighty-nine millimeters by eighty-nine millimeters by nineteen millimeters). The notch, centered in relation to the width of each notched face 30, extends the entire length of that notched face. The notch of each notched face 30 is large enough to accommodate the stem portion 20 of a T-section post 16.

Referring to FIG. 2, assembly by hand of the combination of two T-section posts 16 and two half rings 14 within an annular housing is described here. The stem portion 20 of one of the two T-section posts 16 is inserted into one notch of the spacer 26 and the stem portion 20 of the other T-section post 16 is inserted into the other notch of the spacer 26. The spacer 26 is positioned generally intermediate the ends of the T-section posts 16. A rubber band 28 is stretched over the spacer 26 and the two T-section posts 16. A second rubber band 28 is looped around the T-section posts 16 near their upper ends. The compressive force of the rubber band 28 stretched over the upper portions of the T-section posts 16 acting through the fulcrum established by the spacer 26 tends to force apart the lower ends of the two T-section posts 16. With the rubber bands 28 and the spacer 26 in place, the lower ends of the T-section posts 16 may be placed within the bore of the slip coupling 12. Each T-section post 16 should be slid into the bore of the slip coupling 12 until the end of the T-section post 16 comes into contact with the central ridge 32 of the slip coupling 12. At that point the T-section posts 16 should stand in the proper positions within the bore without assistance, thereby freeing an assembler's hands for inserting the half rings 14.

As illustrated in FIG. 2, each half ring 14 is tilted up with the lower central portion of its convex face 56 placed just within the top of the bore of the slip coupling 12. While the lower central portion of the convex face 56 is maintained within the top of the bore of the slip coupling 12, the stem-abutting edges 52 of each half ring 14 are pinched together enough to slide over the branch portions 18 of the T-section posts 16, and the half rings 14 are rotated down until the stem-abutting edges 52 of the half rings 14 are against the stem portions 20 of the two T-section posts 16. The half rings 14 may then be pushed into the bore of the slip coupling 12 to the central ridge 32. In the preferred embodiment that uses half rings 14 cut from lengths of three-inch-inside-diameter Schedule 40 polyvinyl chloride pipe, the stem-abutting edges 52 of each half ring 14 may be pinched closer together between a thumb and forefinger. A block of wood may be used to press the half rings 14 into the bore. If the half rings 14 fit tightly into the bore, they may be alternately pressed a short distance into the bore until both half rings 14 are in contact with the central ridge 32.

If difficulty is experienced in pressing the half rings 14 into the bore of the annular housing, the half rings 14 probably are too big. This condition may be corrected by removing material from the stem-abutting edges 52 of the half rings 14. The stem-abutting edges 52 may be filed with a hand file to remove the excess material. Both members of a pair of half rings 14 should be filed so that they are the same size when filing is completed. Just enough material should be removed to allow the half rings 14 to be pressed into the bore of the annular housing. If too much material is removed, the half rings 14 will slide into place easily, but they will not press against the T-section posts 16 to hold the assemblage together securely without glue.

With one end of the pair of T-section posts 16 secured by the half rings 14 within an annular housing, the rubber bands 28 and spacer 26 may be removed, and the other end of the pair of T-section posts 16 may be placed within the bore of another annular housing. The half rings 14 may then be positioned and pushed into place as described above.

Because the inner wall 62 of the slip coupling 12 is circular, the flat face of the branch portion 18 of each T-section post 16 describes a chord to the arc of the circle and there is a slight gap between the center of the flat face of the branch portion 18 of each T-section post 16 and the inner wall 62 of the slip coupling 12. When the half rings 14 are pushed into place, they exert an outward force on the center of the branch portion 18 of each T-section post 16, and the T-section post tends to split. The tendency to split may be alleviated by placing tape shims 24 on the flat faces of the branch portions 18 of the T-section posts 16 prior to inserting them into the bore of the annular housing. FIG. 7 illustrates the placement of the tape shims 24 at the ends of the T-section posts 16. In the preferred embodiment each tape shim 24 is a strip of polyvinyl chloride tape, commonly called electrical tape, having a length of approximately one and one-half inches (approximately thirty-eight millimeters) and a width of approximately three eighths of an inch (approximately ten millimeters). As illustrated, each tape shim 24 is placed on the end of a T-section post such that the length of the tape shim 24 follows the length of the T-section post 16, and the width of the tape shim 24 is centered in relation to the width of the flat face of the branch portion 18. When the T-section posts 16 and the half rings 14 are assembled within the bore of the annular housing, the tape shims 24 press against the inner wall 62 of the annular housing, counteracting the tendency of the T-section posts 16 to split.

Figure 6:
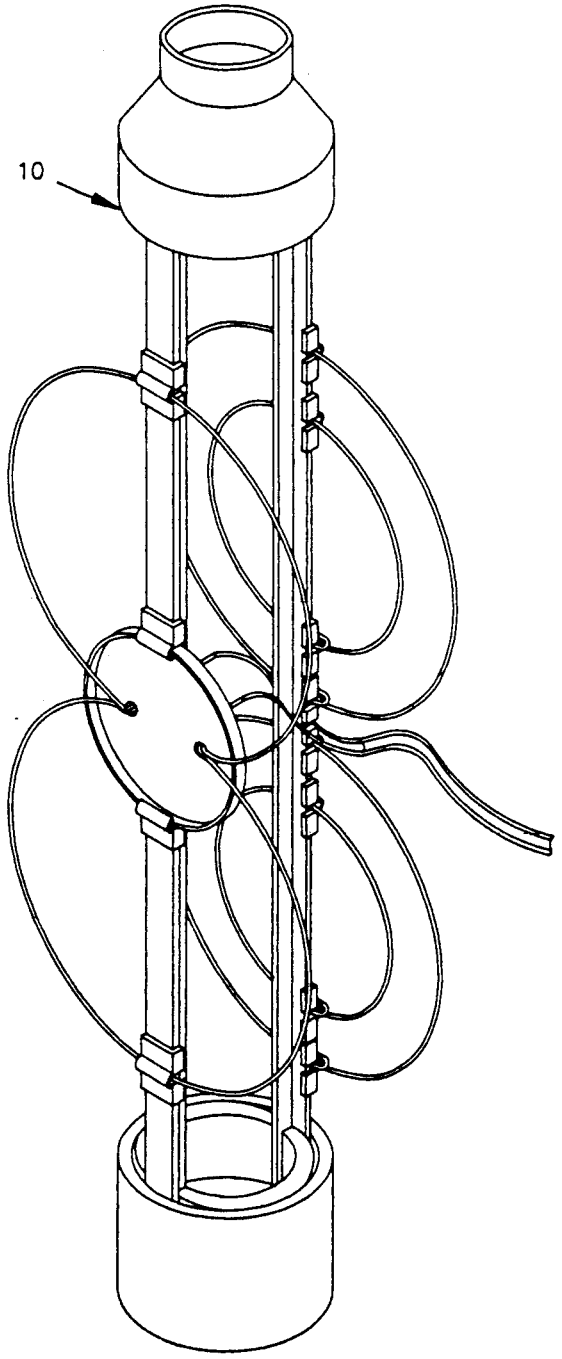
FIG. 6 is a perspective view of a completed antenna assemblage.

FIGS. 6 and 7 show an antenna assemblage utilizing parallel T-section posts 16 connected with half rings 14 within annular housings. Two active loops 40, one above the other, are shown connected to one T-section post 16. Two outer reflector loops 46, one above the other, are connected to the other T-section post 16. Within the perimeter of each outer reflector loop 46 is a smaller inner reflector loop 50.

The antenna elements in the illustrated preferred embodiment are made of one-eighth-inch-diameter (approximately three millimeters) 6061 aluminum alloy solid wire. For each active loop 40, a piece of wire with a length of twenty-two inches (approximately fifty-six centimeters) is bent into a generally circular loop with a one-inch (approximately twenty-five millimeters) portion at each of the two ends of the wire bent substantially perpendicular to the plane of the loop for insertion into one of a pair of holes spaced approximately two inches (approximately fifty-one millimeters) apart in a plastic flanged disk 38. The active loops 40 are secured to the T-section posts 16 with double snap clips 34; the flanged disk 38 is secured to the T-section post 16 with single snap clips 36; and the ends of the active loops 40, after being inserted through the holes in the flanged disk 38, are secured to a twin-lead transmission line 44 with a pair of alligator clips 42; as described in my U.S. Pat. No. 4,872,022.

For each outer reflector loop 46, a piece of wire with a length of thirty inches (approximately seventy centimeters) is bent into a generally circular loop. For each inner reflector loop 50, a piece of wire with a length of twenty-four inches (approximately sixty-one centimeters) is bent into a generally circular loop. A hook 48 is created at each end of the wire that forms each outer reflector loop 46. Similar hooks are created in the wire forming the inner reflector loops 50. For each reflector loop, one hook is bent into the loop and one hook is bent out of the loop. The hooks of each reflector loop are wrapped around the central portion of a double snap clip 34 that is then snapped onto the T-section post 16.

I claim:

1. Connection of two T-section posts between two half rings within an annular housing, wherein:

said annular housing having a substantially circular inner wall that defines a bore within said annular housing, said T-section posts being positioned within said annular housing such that said T-section posts extend substantially parallel to a central axis of said bore of said annular housing, each T-section post having a stem portion extending from a center of a branch portion, said stem portion being substantially a perpendicular bisector of said branch portion, said branch portion of each of said T-section posts having a flat face, said flat face of said branch portion of each of said T-section posts being positioned within said bore of said annular housing substantially against said inner wall of said annular housing, each of said half rings being positioned within said annular housing such that each half ring has two edges that extend substantially parallel to the central axis of said bore of said annular housing, one of said edges abutting said stem portion of one of said T-section posts and the other of said edges abutting said stem portion of the other of said T-section posts, said edges being referred to as stem-abutting edges, each half ring having a convex face positioned against said inner wall of said annular housing except near each T-section post, where said branch portion of said T-section post is between said convex face of said half ring and said inner wall of said annular housing, said stem portion of each T-section post being between one of said stem-abutting edges of one of said half rings and one of said stem-abutting edges of the other of said half rings.

2. Connection as claimed in claim 1 wherein said bore of said annular housing is tapered, being smaller into said bore, whereby:

pressing said half rings into said bore of said annular housing presses said half rings tighter against said T-section posts, thereby locking said half rings and said T-section posts within said bore of said annular housing.

3. Connection as claimed in claim 1 wherein said T-section posts are rigid fiberglass-reinforced plastic.

4. Connection as claimed in claim 2 wherein said annular housing is a polyvinyl chloride slip coupling and said half rings are cut sections of polyvinyl chloride pipe.

5. Connection as claimed in claim 4 wherein said polyvinyl chloride slip coupling has an inside diameter of approximately three-and-one-half inches and said polyvinyl chloride pipe is a Schedule 40 pipe with an inside diameter of approximately three inches and an outside diameter of approximately three-and-one-half inches.

6. Connection as claimed in claim 1 wherein a strip of tape is between said inner wall of said annular housing and a central portion of a width of said flat face of said branch portion of each of said T-section posts, whereby said strip of tape presses against said inner wall of said annular housing and counteracts a tendency of said T-section post to split.

7. Connection as claimed in claim 1, including an assemblage comprising said T-section posts, two pairs of half rings, and two annular housings, wherein said T-section posts are of equal length, and, at each end of said T-section posts, said T-section posts are connected between two of said half rings within one of said annular housings.

8. Antenna assemblage including assemblage as claimed in claim 7 wherein antenna elements are connected to said T-section posts.

9. Antenna assemblage as claimed in claim 8 wherein a plurality of active antenna elements are attached to one of said T-section posts and a plurality of reflector elements are attached to the other of said T-section posts.

10. Antenna assemblage as claimed in claim 9 wherein:

said T-section posts are made of a rigid plastic, said active antenna elements comprise a pair of open loop elements connected together and attached to a balanced transmission line, and said reflector elements comprise a plurality of closed loop elements.

* * * * *